United States Patent [19]

Kariakin

[11] Patent Number: 4,534,924

[45] Date of Patent: Aug. 13, 1985

[54] METHOD FOR MOLDING CONCRETE SLABS AND BATTERY MOLD THEREFOR

[75] Inventor: Joseph A. Kariakin, Salem, Oreg.

[73] Assignee: Novi Development Corporation, Salem, Oreg.

[21] Appl. No.: 533,431

[22] Filed: Sep. 19, 1983

[51] Int. Cl.[3] ..... B28B 1/16

[52] U.S. Cl. ..... 264/259; 249/84; 249/120; 249/129; 249/139; 264/256; 264/274; 264/297.9

[58] Field of Search ..... 249/84, 120, 129, 119, 249/131, 139, 163, 167; 264/274, 297.9, 35, 279, 256, 259

[56] References Cited

U.S. PATENT DOCUMENTS

| | | | |
|---|---|---|---|
| 415,174 | 11/1889 | McCarty | 249/84 |
| 1,760,282 | 5/1930 | Pederson | 249/120 |
| 2,831,232 | 4/1958 | Lawson | 249/129 |
| 3,220,692 | 11/1965 | Eklund | 249/120 |
| 3,488,817 | 1/1970 | Katz | 249/120 |
| 3,628,766 | 12/1971 | Hartmann | 249/129 |
| 3,701,508 | 10/1972 | Cross | 249/129 |
| 3,743,235 | 7/1973 | Shelley | 249/121 |
| 3,785,608 | 1/1974 | Heinzman et al. | 249/161 |
| 3,804,361 | 4/1974 | Camus | 249/78 |
| 3,843,089 | 10/1974 | Scholz et al. | 249/158 |
| 3,844,524 | 10/1974 | Fisher et al. | 249/120 |
| 3,873,058 | 3/1975 | Jeffery | 249/161 |
| 3,881,856 | 5/1975 | Fougea | 249/120 |
| 3,892,516 | 7/1975 | McGrew et al. | 425/443 |
| 3,954,377 | 5/1976 | Scholz et al. | 425/432 |
| 4,067,941 | 1/1978 | Gaudelli et al. | 264/69 |
| 4,135,695 | 1/1979 | Capdevila et al. | 249/118 |
| 4,191,521 | 3/1980 | Muldery et al. | 425/432 |

FOREIGN PATENT DOCUMENTS

| | | | |
|---|---|---|---|
| 0055877 | 7/1982 | European Pat. Off. | 249/84 |
| 136220 | 2/1961 | U.S.S.R. | 249/120 |
| 150046 | 9/1962 | U.S.S.R. | 249/120 |
| 489643 | 2/1976 | U.S.S.R. | 249/120 |

*Primary Examiner*—Jay H. Woo
*Assistant Examiner*—James C. Housel
*Attorney, Agent, or Firm*—Price, Heneveld, Huizenga & Cooper

[57] ABSTRACT

A method and apparatus for vertically molding concrete slabs in which a tilted semi-cubical enclosure is provided containing a plurality of plates spacedly positioned from one another such that a cavity is formed between plates in which the slabs are formed. The tilt of the enclosure maintains the plates and spacers in their desired positions during loading and unloading of the enclosure. Within one aspect of this invention the spaced plates are insulation plates having fasteners projecting therefrom into cavities such that when concrete is poured into and permitted to harden in the cavities, the insulation plates will be laminated to the concrete.

18 Claims, 11 Drawing Figures

METHOD FOR MOLDING CONCRETE SLABS AND BATTERY MOLD THEREFOR

BACKGROUND OF THE INVENTION

This invention relates to the molding of concrete slabs, and more particularly, to an apparatus and method for molding a plurality of concrete panels or slabs simultaneously. Molds of this type are commonly called battery molds.

Premolded concrete slabs have great utility in the construction of many concrete structures. It is possible with premolded concrete slabs to quickly assemble a building on site. There have been many devices in the past for molding a plurality of such slabs simultaneously from a single mold apparatus. Typically these devices employ a plurality of vertical plates spaced from one another so as to define cavities therebetween for molding the concrete slabs. However, such prior art vertical battery molding devices are quite complicated apparatus and difficult to both assemble and operate. The reason for this is that complicated means have been required to provide and hold the proper spacing between the plates. Thus, heavy shoring and complicated fasteners and other mechanisms are provided. Examples of such devices are disclosed in U.S. Pat. Nos. 3,873,058, 3,804,361 and 3,743,235.

U.S. Pat. No. 3,873,058 issued to Jeffery on Mar. 25, 1975, entitled MOULDING APPARATUS, discloses a plurality of locks employed to lock the molding cavities together during pouring and curing of the concrete and a plurality of rollers to separate the molds when the molds are unlocked and the slabs are being removed. U.S. Pat. No. 3,804,361 issued to Camus on Apr. 16, 1974, entitled PLANT FOR MANUFACTURING REINFORCED CONCRETE CONSTRUCTION PANELS, discloses a device requiring heavy shoring movable on rollers. Still other devices actually suspend the molds above the ground requiring means for suspending the molds above the ground, devices for holding the molds together during pouring and curing of the concrete slabs, and means for separating the molds after the concrete has cured. Such a device is disclosed in U.S. Pat. No. 3,743,235 issued to Shelley on July 3, 1973, entitled APPARATUS FOR FABRICATING UNITS OF MOLDABLE BUILTING MATERIAL.

SUMMARY OF THE INVENTION

The apparatus and method disclosed in the present invention provides a simple, economical way of vertically molding a plurality of concrete slabs simultaneously. The device is quickly assembled and charged with concrete, and can be quickly disassembled to remove the hardened concrete slabs. The apparatus also provides a convenient way of molding concrete slabs laminated with other building materials such as insulation board or waferboard. In addition, it is possible with the battery mold to cast concrete slabs of different thicknesses together in the same battery. Finally, it is possible with the present invention to eliminate the molding plates commonly used in vertical battery molding operations and replace them with plates made from building laminate materials which remain fixedly secured to the concrete slabs molded in the device.

The present invention comprises a method and apparatus for molding concrete slabs which comprises a plurality of plates spacedly positioned from one another by spacer means in a semi-cubical enclosure so that a cavity is formed between adjacent plates. The enclosure which has a bottom wall, two sidewalls, and an end wall is tilted several degrees from the horizontal. The plates are positioned in the enclosure such that they are substantially perpendicular to the bottom wall and the sidewalls. The plates extend between the two sidewalls and substantially parallel to the end wall. Spacers are provided to maintain the plates in spaced relationship to one another. Finally, means are provided for biasing the plates against the spacer means in the direction of the tilt against one of the parallel walls.

Within the broader concepts of this invention, two embodiments are disclosed. In one embodiment, the enclosure is a box-like construction, and in the second embodiment, the enclosure is a cavity or pit all of which will be disclosed in greater detail hereinafter.

Within another aspect of this invention, the method and apparatus permits the casting of the concrete wall in combination with an insulation panel or board, the panel providing a dual function not only ultimately constituting a laminate portion of the final slab but during the pouring step providing the means for defining the cavity into which the concrete is poured.

DETAILED DESCRIPTION OF THE PREFERRED EMBODIMENT

Figure 1:
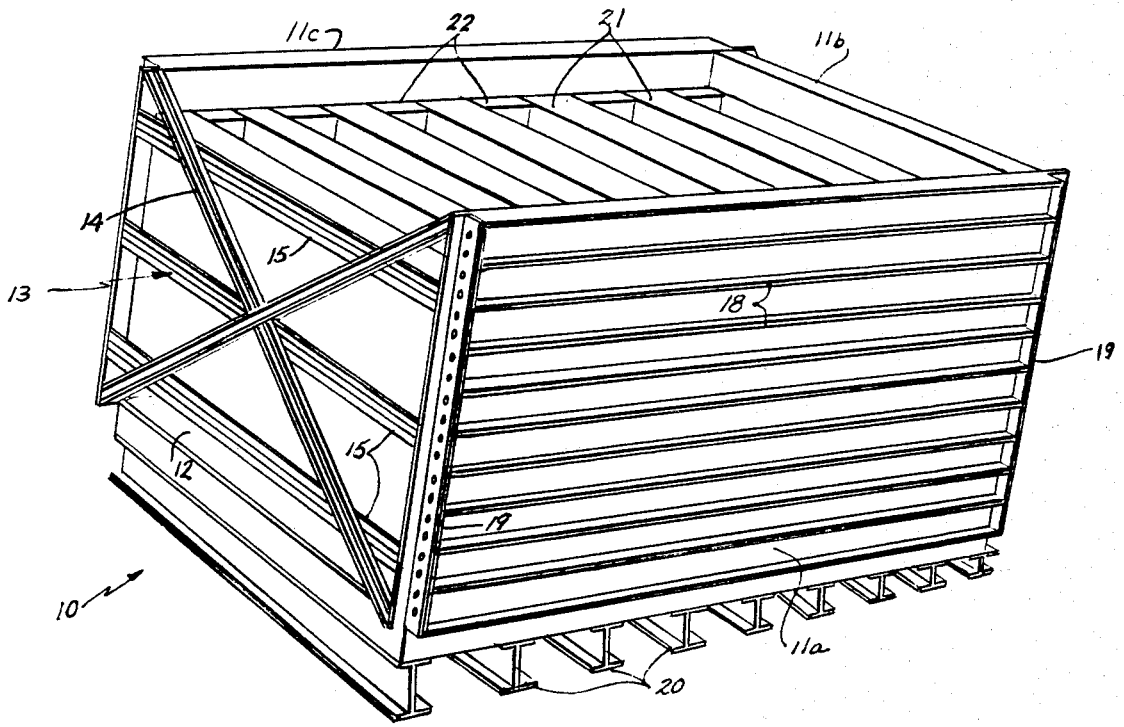
FIG. 1 is a perspective view of a battery mold of the present invention.

The preferred embodiment of the present invention is shown in FIG. 1 as comprising a battery box 10 comprising a box-like or semi-cubic enclosure with sidewalls 11*a* and 11*c*, end wall 11*b*, and bottom 12. The box has an open top and is tilted at a slight angle.

Figure 2:
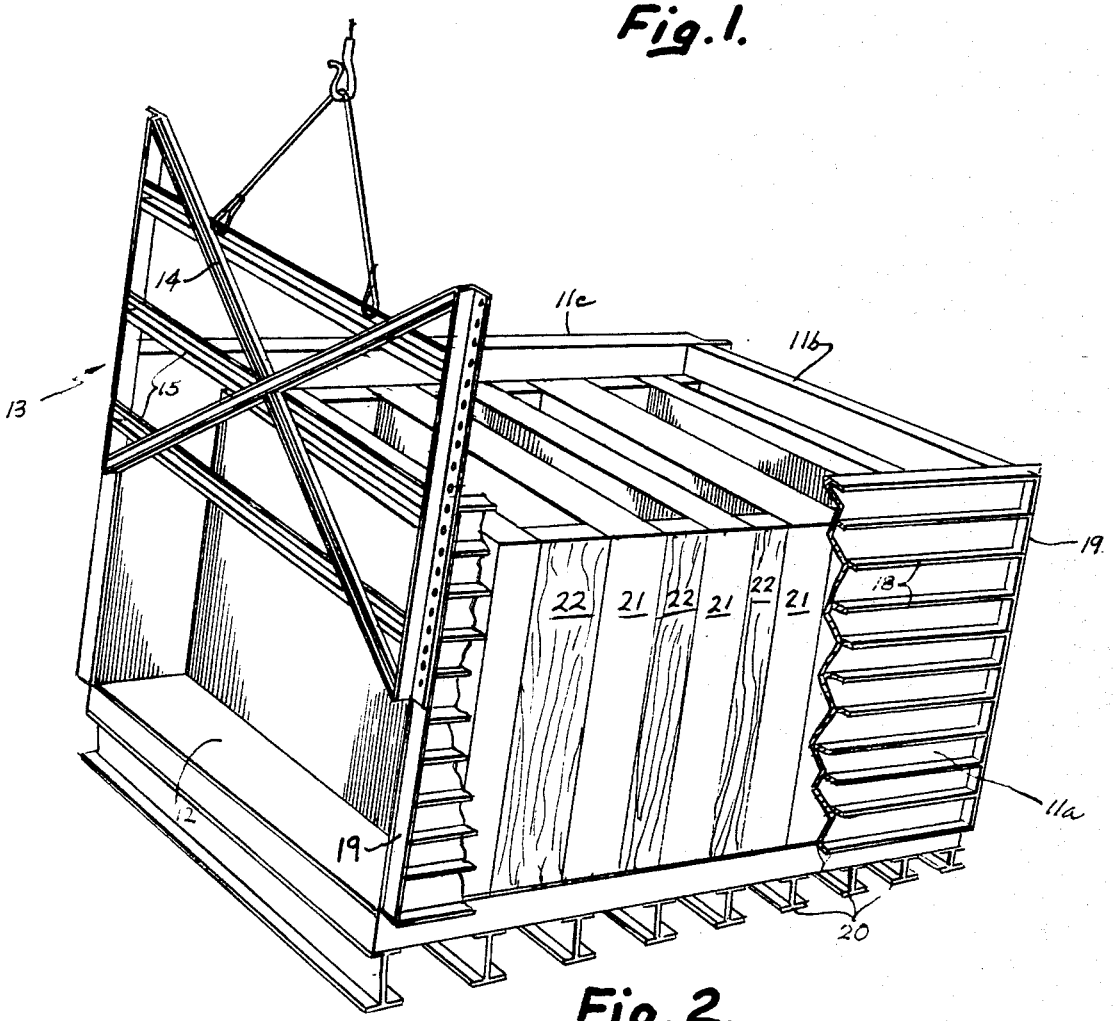
FIG. 2 is a cut-a-way perspective view of the battery mold of this invention showing the end bracing being installed.

As shown in FIGS. 1 and 2, battery box 10 contains therein a plurality of removable plates 21 which are spacedly positioned one from another by spacers 22. Plates 21 and spacers 22 form a cavity 22*a* between adjacent plates. As is discussed in more detail below, cavities 22*a* are used for pouring concrete therein and molding concrete slabs. Bracing 13 includes cross bracing members 14 and spaced transverse bracing members 15 which help keep the sidewalls 11*a* and 11*c* together at the open end of the box as well as keep the assembly of plates described below from falling apart due to the pouring pressure of the concrete.

Each sidewall 11*a* and 11*c* and end wall 11*b* has transverse wall reinforcement members or flanges 18 thereacross and upright wall reinforcement members 19 along either upright edge thereof. The transverse and upright wall reinforcement members are made from steel typically and reinforce a metal plate 19*a* which forms the wall. It should be understood that the same construction as described above is used on sidewall 11*c* and end wall 11*b* as well. As shown in FIG. 1, the battery box 10 is tilted from the vertical by means of I-beam supports 20 which, as shown in FIG. 1, progressively increase in cross-sectional height across the bottom of battery box 12 from end wall 11*b* to the open end of battery box 10. It is important that battery box 10 is tilted in the direction of end wall 11*b* as will be explained hereinafter.

Plates 21 are conveniently made from concrete. However, they can be made from wood, plastics, steel or any combination of commonly used building materials. As is well known in the art, however, the concrete plates will adhere to the concrete slabs cast in cavities 22*a* unless plates 21 are coated with a demolding substance. Such substances are currently available on the market and are well known in the art.

Spacers 22 are preferably made from standard sized lumber. For instance, standard 2×4's are readily usable. It is preferable to use the same sized spacer on either side of a given cavity so as to maintain the plates defining the cavity parallel to one another. It should be obvious that spacers of many different sizes can be used. In fact, many different cast concrete slab thicknesses can be cast in the same mold simultaneously by using different sized wood spacers from cavity to cavity. Of course, it is also possible to use the same sized wood spacers in all cavities thereby casting a plurality of slabs of the same thickness.

Plates 21 and spacers 22 are insertable and removable from battery box 10, plates 21 being removable by an overhead crane. Plates 21 and spacers 22 are maintained in the position shown in FIG. 2 by the tilt of the box and by being sandwiched between end wall 11*b* and bracing 13.

Figure 3:
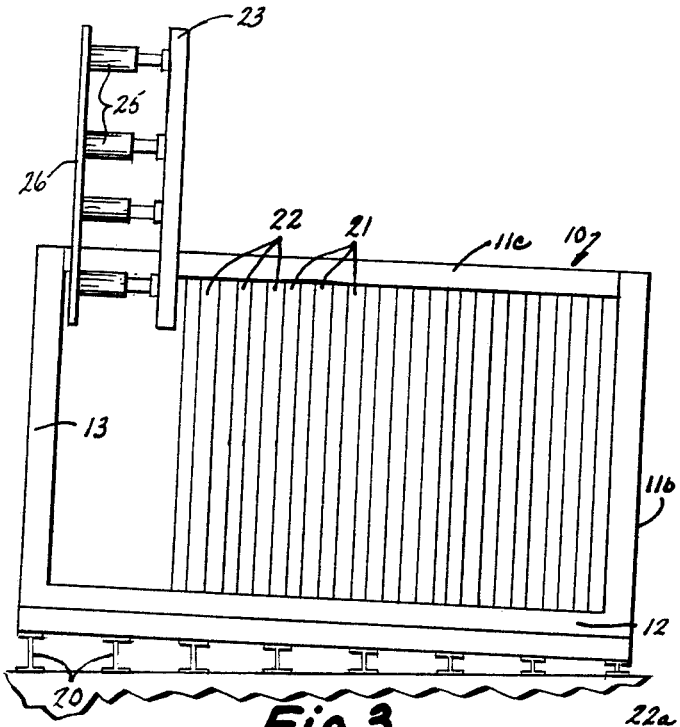
FIG. 3 is a side cross-sectional view of the battery mold of the present invention illustrating the use of jacks for biasing the battery molding plates.

It is usually convenient to fill battery box 10 completely with plates 21 and spacers 22 so that the plates and spacers fill the length of battery box 10 between end wall 11*b* and bracing 13, as shown in FIG. 2. However, as shown in FIG. 3, a jack spacer 23 can be provided so as to bias the plates 21 and spacers 22 toward end wall 11*b* if the entire battery box 10 is not filled. Jack spacer 23 comprises a jack plate 24 which abuts the last plate 21 in battery box 10. Jack frame 25 abuts bracing 13 and jacks 25 are adjustable so as to accommodate a different number of plates 21 and spacers 22 in battery box 10.

OPERATION

The operation of battery molding device described above is quite simple. Battery box 10 is tilted by I-beams 20 toward one wall, say, end wall 11*b*. A first pair of spacers is positioned against end wall 11*b*, one at the corner of end wall 11*b* and sidewall 11*a*, the other at the corner of end wall 11*b* and sidewall 11*c*. One plate 21 is leaned against the first pair of spacers and, of course, is parallel to end wall 11*b* and perpendicular with sidewalls 11*a* and 11*c*. Since battery box 10 is tilted toward end wall 11*b*, the first plate 21 will stay in position against the first pair of spacers 22 without any support.

A second pair of spacers are positioned against the first plate, one spacer is positioned at the corner formed by the first plate and sidewall 11*a*, the other spacer is positioned in the corner formed by the first plate and sidewall 11*c*. A second plate is leaned against the second pair of spacers and will remain in that position due to the tilt of the battery as indicated above.

Additional spacers and plates are alternately loaded until the box is filled to the desired capacity. If the box is not completely filled, jack spacer 22 can be positioned between bracing 13 and the last plate installed. Of course, if the plates are made from concrete, they should be coated with one of the commercially available demolding substances.

Once the battery box 10 is filled with the desired number of plates and spacers, a plurality of cavities 22*a* are formed between plates 21. Concrete is poured into these cavities and allowed to cure. Once the concrete is sufficiently hardened, bracing 13 is removed which permits the sidewalls to be sufficiently loose to provide movement for the slabs to release easily, or jack spacer 23 is lifted out of position and the last plate can be lifted, exposing a first molded concrete slab. The first molded concrete slab is lifted preferably by means of an overhead crane. The spacers separating the last plate from the second to the last plate are removed as well.

The second-to-the-last plate is then removed exposing a second concrete slab which is also removed along with the spacers in that cavity. This removal procedure is repeated until the first plate and the last concrete slab is removed. Battery box 10 is then reloaded as described above.

MODIFICATIONS

Figure 7:
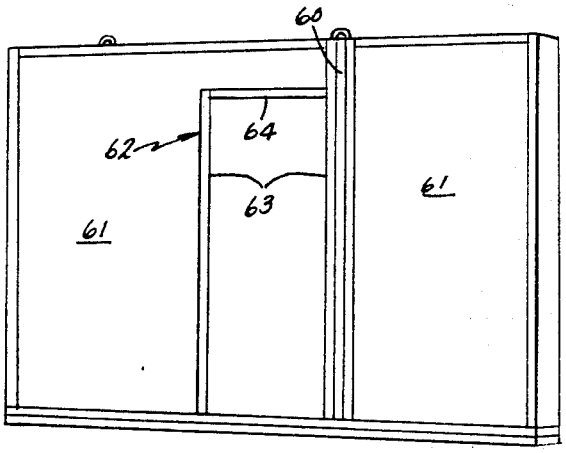
FIG. 7 is a front view of two completed panels which were simultaneously cast in the battery mold of the present invention.

In addition to the flexibility one has in varying the thickness of the molded slabs cast in battery box 10, the width of the molded concrete slabs can be varied as well. As shown in FIG. 7, a cavity divider 60 which conveniently comprises a piece of standard size lumber the same size as spacers 22 can be inserted into a cavity intermediate spacers 22. Divider 60 an thereby form two cavities 61 smaller than the undivided cavity.

Also shown in FIG. 7 is a door blockout 62 which can conveniently be used to cast a doorway in a concrete slab, where the concrete is to be used as a vertical wall in a building. Door blockout 62 comprises vertical frame members 63 and a horizontal frame member 64. The horizontal frame member 64 being on top prevents concrete from flowing into the region inside door blockout 62 provided the frame members 63, 64 are of the same transverse dimension as spacers 22.

FIG. 7 also illustrates bottom spacers 66 which can be used to position the curing concrete above the bottom wall 12 (not shown). Bottom spacers 66 help to hold the plates parallel and provide a nailable surface used to easily attach weld plates and any other necessary embedments in the bottom of the concrete slab. Also they make it easier to remove the cured slabs from the mold since adhesion between the bottom wall and the cured slabs is reduced.

Figure 6:
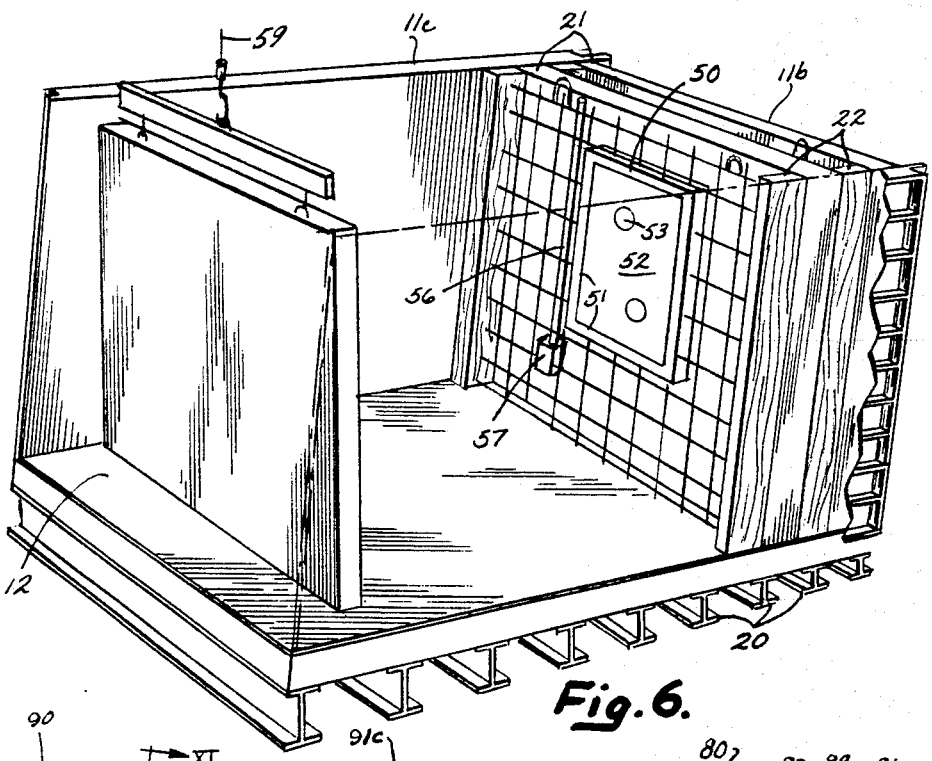
FIG. 6 is a partially broken, perspective view of the present invention showing one type of concrete slab which can be molded with the present invention.

A window blockout 50 can also be used as shown in FIG. 6. A window blockout comprises horizontal frame members 51*a* and vertical members 51*b* secured to each other in a rectangular frame. A piece of plywood 52 is secured to one side of the rectangular frame and when using concrete for the form plate, a pair of coil bolts 53 are used to secure plywood 52 and frame members 51 directly to a plate 21 so as to keep the window blockout 50 above the bottom of the battery box 10. If wood plates are used, simple nailing of the window blockout to the wood frame is adequate. When the blockout 50 is disposed between two spacers and the frame members of blockout 50 have the same thickness as spacers 22, shown in FIG. 6, the next plate 22 being loaded by overhead crane to be leaned against spacers 22 and blockout 50 forms a cavity between the spacers and the parallel plates. It should be apparent when concrete is poured from the top of the battery box into the cavity so formed, the concrete will flow around window blockout 50, the window blockout forming an opening in the concrete slab cast in the cavity after the concrete slab hardens.

The use of concrete reinforcement mat 54 is also shown in FIG. 6. The mat 54 can be spaced between two adjacent plates by means of mat spacers 88 shown in FIG. 9. Electrical conduit 56 and an outlet box 57 can also be cast in a concrete panel as illustrated in FIG. 6. FIG. 6 also shows that hooks 55 can be wired to mat 54. Hooks 55 extend above spacers 22 so as to provide hooks for the overhead crane to lift the concrete slab molded in battery box 10 once the concrete hardens. Hooks 55 can be molded into any slab manufactured in the above process and provides a convenient way of removing the molded concrete slabs from the battery box.

Figure 8:
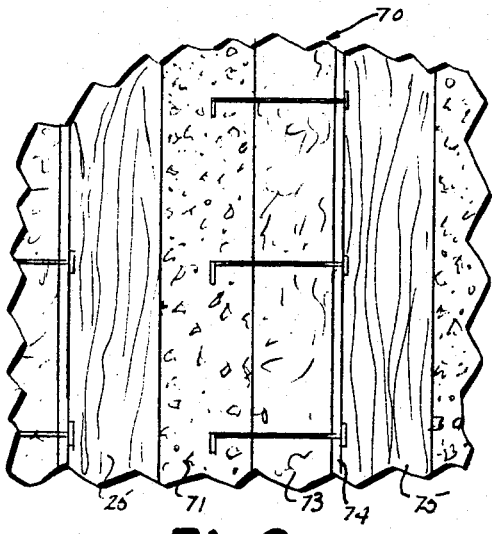
FIG. 8 is a detail, partial, cross-sectional view of a concrete slab cast with a building material laminate in accordance with this invention.

Many other variations are possible. As shown in FIG. 8, for instance, a cast-in-cavity laminate 70 comprising a concrete slab 71, insulation board 73 and waferboard sheath 74 held together by anchors 72 can be cast between plates 75. Such construction is particularly valuable in residential construction where insulation reduces heating costs. Furthermore, the waferboard can provide a surface onto which an attractive exterior plywood or other ornamental sheathing can be nailed. It should be obvious to one skilled in the art that other types of building materials can be laminated to a concrete slab 71 in the same fashion.

Figure 9:
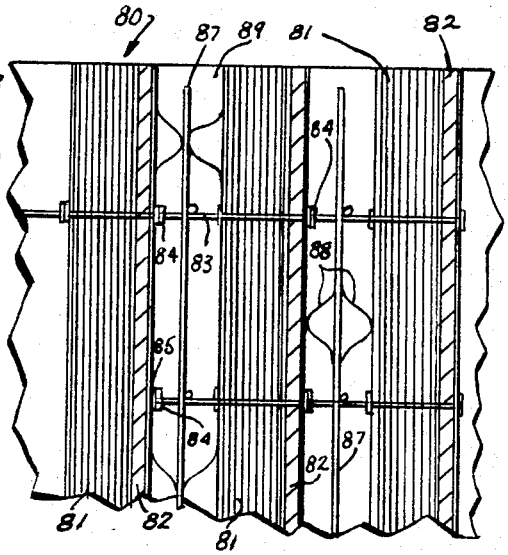
FIG. 9 is a partial, detail view in cross section illustrating the use of a building material laminate as casting plates in the battery mold of the present invention.

Within one aspect of the invention as shown in FIG. 9, concrete spacers 22 can be entirely eliminated by using a building material laminate 80 as plates instead. The laminate plates 80 are spaced by means of spacers 83. Each spacer 83 comprises an elongated bar 83*a* which protrudes through the laminate 80. Head 85 is provided on the bar to prevent the spacers from pulling through the laminate under the pouring pressure of the concrete. Foot 84 is provided on each bar to prevent spacers 83 from piercing the next building laminate plate. Further, retainer 83*b* is provided to prevent the laminate 80 from sliding laterally along the body 83*a* under the force of the concrete pressure on the laminate when one cavity is filled with concrete and an adjacent cavity is not as evenly filled. The building laminate plates are conveniently constructed of a rigid insulation board 81 and a plywood sheath 82. The insulation board can be made from any rigid foamed material. Polyisocyanurate having an aluminum covering is preferred.

Figure 4:
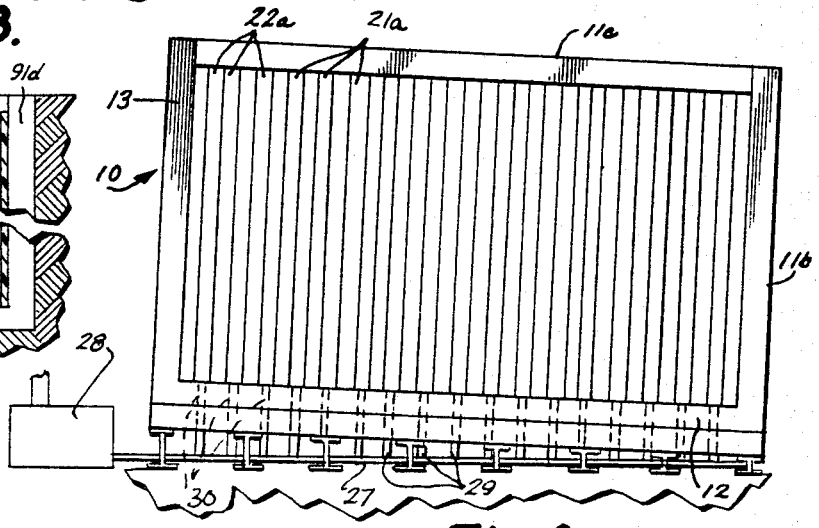
FIG. 4 is a side cross-sectional view of the battery mold of the present invention employing a manifold and concrete pump for pumping concrete from the bottom of the mold into each cavity.

Another modification of the battery mold of the present invention is shown in FIG. 4. A concrete pump 28 can be used to pump concrete through the bottom of battery box 10 into each cavity by means of manifold 27 which is in fluid communication with risers 29 and is designed to allow for ease in cleaning. Risers 29 are received in bores 30 in the bottom wall 12 of battery box 10 and are positioned such that each riser is in fluid communication with a different cavity 22*a*.

The advantage of pumping concrete through the bottom is that the concrete will fill the cavities evenly, dispersing pressure evenly on the plates. The even filling of the cavities is important to the success of this molding process. When filling the mold from above, care must be taken to fill the cavities evenly so as not to fill a cavity to a point where the concrete pressure is high enough to bend the plates of the adjacent cavities, producing undesirable walls. The nature of pumping from below with a manifold automatically fills the cavities evenly eliminating the careful monitoring procedures used in filling the cavities from above.

Figure 5:
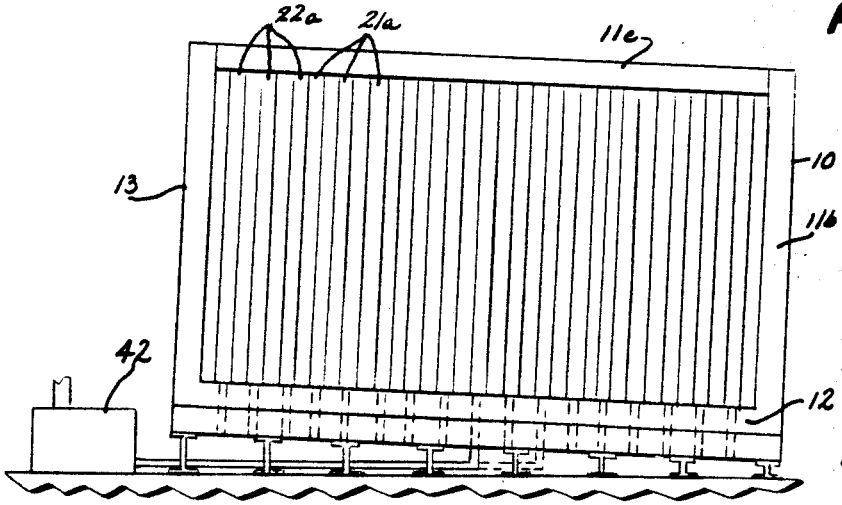
FIG. 5 is a side cross-sectional view illustrating a second method of pumping concrete through the bottom of the mold into each cavity.

Another bottom pumping arrangement is disclosed schematically in FIG. 5 wherein a plurality of risers 40 can individually be connected with a hose 41 for pumping concrete with a pump 42 into each cavity 22*a* individually. In this modification, one-way valves (not shown) are provided in combination with the risers to prevent blackflow of concrete once it is pumped upward into each cavity.

Figure 11:
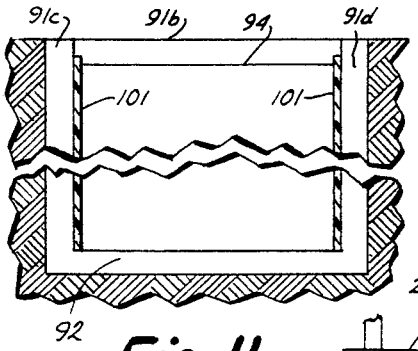
FIG. 11 is a fragmentary, cross-sectional view taken along the plane XI—XI of FIG. 10.
Figure 10:
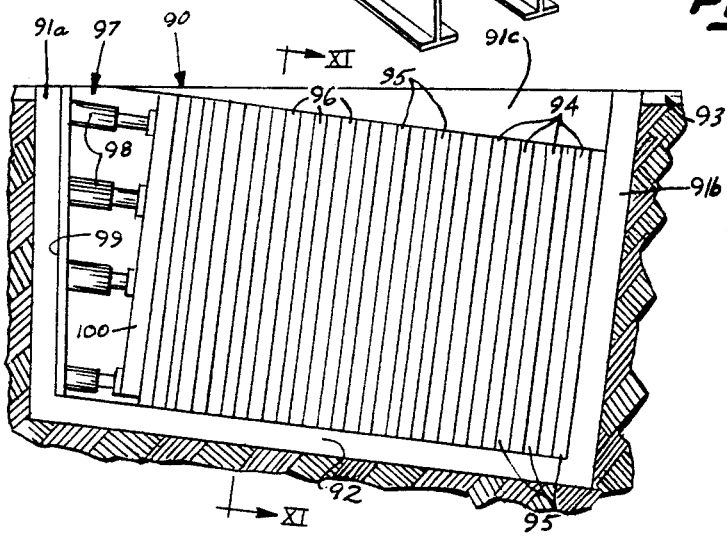
FIG. 10 is a side, cross-sectional view of an in-ground embodiment of the battery molding apparatus of the present invention.

As shown in FIG. 10 a battery box 90 can be installed in ground, the top of the battery box being level with the floor or ground level indicated as 93. Such a box would include two sidewalls and two end walls, one sidewall not being shown inasmuch as the view in FIG. 10 is in cross section. The bottom wall 92 is at a slight angle with the horizontal. One end wall 91*b* is perpendicular to bottom wall 92. One end wall 91*a* is perpendicular to the ground. The two sidewalls 91*c* and 91*d* (FIG. 11) are perpendicular to both ground and bottom wall 92. End wall 91*a* is not perpendicular to bottom wall 92 for the simple reason that it would be difficult to pack plates 94 and spacers 95 tightly enough in battery box 90 between two parallel walls 91*a* and 91*b*. It is more convenient to have end wall 91*a* perpendicular to the horizontal and at a slight angle with end wall 91*b* so that a jack spacer 97 shown in FIG. 10 can be installed between end wall 91*a* and the last plate loaded in battery box 90. Jack spacer 97 is in all respects identical to jack spacer 23 shown in FIG. 3 with the exception that the individual jacks 98 are adjusted such that the jack frame 99 is parallel to end wall 91*a* and the jack plate 100 is parallel to plates 94. Jacks 98 can be adjusted so as to create a tension between end wall 91*a* and plates 94 resisting the pouring pressures of the concrete when the concrete is poured into cavities 96.

To facilitate unloading of the battery box, foam spacers 101 of 25 p.s.i. compressive strength can be placed on the inside surfaces of the battery box sidewalls. This facilitates the necessary movement needed to demold. The foam crushes enough to allow room for release of the panel without having to move the sidewalls for demolding. This is necessary in this in-ground battery mold embodiment and also can be used in the above ground embodiment in which the sidewalls are not movable so as to permit demolding.

The advantage of in-ground molding is that there is no need for a concrete pump to pump concrete into the top of the battery box as is the case in the embodiments shown in FIGS. 1 through 3. In addition, plates 94 and the cast concrete slabs 95 formed in cavities 96 need not be lifted vertically as far as similar structures in the embodiments shown in FIGS. 1 through 3 during disassembly of the concrete battery mold reducing the overhead space requirements for operation of the concrete battery mold. In other words, the building in which battery molding operations is carried out can be shorter and smaller.

When molding concrete slabs in in-ground battery box 90, the walls 91*a* through 91*d* and bottom wall 92 conveniently can be made from concrete or other materials as above disclosed. The plates 94 and spacers 95 can be identical to the plates and spacers previously described in relation to the above ground embodiment. Further, all other pertinent modifications such as that described in relation to FIGS. 4, 5, 6, 7, 8 and 9 can be utilized with the in-ground embodiment.

It should be obvious that the battery molding method and apparaus described here in much simpler than prior art vertical concrete slab molding methods and devices both in construction and operation. The apparatus is easily constructed from standard materials. The components can be quickly assembled facilitating operation. Notwithstanding this simplicity, a variety of concrete slabs with different thicknesses, widths and configurations are castable with this invention.

Of course, it is understood that the above is merely the preferred embodiment of the invention and that various changes and alterations may be made without departing from the spirit and broader aspects of the invention.

The embodiments of the invention in which an exclusive property or privilege is claimed are defined as follows:

1. A battery mold for substantially vertically molding of concrete slabs comprising:

(a) a battery enclosure including a unitary box having a bottom wall, two sidewalls and an end wall, said entire enclosure being tilted so as to tilt the bottom wall a slight angle to the horizontal and the end wall a slight angle from the vertical with the sidewalls arranged vertically;

(b) a plurality of separator plate means located within said unitary box each of which is parallel to the end wall and perpendicular to said bottom wall and said sidewalls, said plates extending between said sidewalls;

(c) means for spacedly positioning each of said plate means for an adjacent plate means so that a cavity for concrete slab molding is formed therebetween and whereby said plate means are arranged at the same slight angle of tilt as said bottom and end walls, such angle of tilt being sufficient without any additional support to maintain said plates in said box before pouring of concrete therein; and (d) means for biasing the plates toward said end wall after said separate plate means are in place ready for pouring of concrete.

2. The battery mold as recited in claim 1 wherein said plate means comprise concrete plates with means to prevent the concrete to be poured in said cavities from adhering to said plates.

3. The battery mold as recited in claim 1 wherein said enclosure is recessed into the ground.

4. The battery mold as recited in claim 3 wherein said enclosure has two sidewalls and two end walls and the tops of said sidewalls and end walls are substantially even with the surface of the ground.

5. The battery mold as recited in claim 4 wherein said plates comprise a building material laminate to be laminated to said concrete poured in said cavities formed between said plates.

6. The battery mold as recited in claim 1 wherein said plates comprise a building material laminate to be laminated to said concrete poured in said cavities formed between said plates.

7. The battery mold as recited in claim 1 which further comprises manifold means in fluid communication with the bottom of each of said cavities for pumping concrete into said cavities from the bottoms of said cavities.

8. The battery mold as recited in claim 1 wherein means for dividing at least one of said cavities between said plates into at least two smaller cavities are provided whereby concrete slabs of different sizes can be molded in the same molding operation.

9. The battery mold as recited in claim 1 wherein said spacing means comprises spacers.

10. The battery mold as recited in claim 9 wherein said spacers comprise elongate pieces of lumber, two pieces being placed in each cavity, each piece being positioned along a vertical edge of said plates.

11. The battery mold as recited in claim 10 wherein at least one pair of spacers in one cavity is of a different thickness from spacers in other cavities.

12. The battery mold as recited in claim 6 which further includes fastening means projecting from each of said plates into at least one of said cavities adjacent said plate, said fastening means assisting in holding the plates in spaced position.

13. A method of molding concrete slabs comprising:

(a) providing a unitary battery box with two sidewalls, a bottom wall perpendicular to and extending between said sidewalls and an end wall perpendicular to said sidewalls and bottom wall and extending between said sidewalls;

(b) arranging said battery box at a slight tilted angle whereby said end wall is tilted at a slight angle from the vertical and said bottom is tilted at the same said slight angle from the horizontal with said sidewalls being vertical;

(c) spacedly positioning one at a time a plurality of separator plates from one another within said unitary battery box so that a cavity is formed between adjacent plates, and such that said plates are substantially perpendicular to and extend between said two sidewalls and are substantially parallel to said end wall whereby said plates are each tilted and the angle of tilt is the same as said tilted angle of said bottom and end walls, such angle of tilt being slight but sufficient without any additional support to maintain said plates in said box before pouring of concrete therein;

(d) applying a force to the separator plate furthest removed from said end wall thereby holding all of said separator plates in place within said unitary battery box in spaced position; and (e) pouring concrete into the cavities between said plates.

14. The method as recited in claim 13 which further comprises recessing said battery into the ground.

15. The method as recited in claim 13 wherein building material laminates to be laminated to said concrete poured into said cavities are provided as said plates.

16. The method as recited in claim 13 wherein concrete is pumped into said cavities through the bottom of said battery.

17. The method as recited in claim 15 wherein a plurality of elongated fastening means are provided; attaching said fastening means to each plate and causing said fastening means to project from each plate into one of the cavities adjacent said plate whereby upon performing the step of pouring concrete into said cavity the concrete envelops said fastening means causing each plate to be fixedly secured to said slabs after curing of said slabs.

18. The method as recited in claim 17 wherein each plate is provided with more than one layer of building material laminate.

* * * * *